US005194877A

United States Patent [19]

Lam et al.

[11] Patent Number: 5,194,877

[45] Date of Patent: Mar. 16, 1993

[54] PROCESS FOR MANUFACTURING THERMAL INK JET PRINTHEADS HAVING METAL SUBSTRATES AND PRINTHEADS MANUFACTURED THEREBY

[75] Inventors: Si-Ty Lam, Pleasanton; Howard H. Taub, San Jose, both of Calif.

[73] Assignee: Hewlett-Packard Company, Palo Alto, Calif.

[21] Appl. No.: 705,218

[22] Filed: May 24, 1991

[51] Int. Cl.[5] ..... B41J 2/05; C25D 1/00

[52] U.S. Cl. ..... 346/1.1; 29/890.1; 205/67; 205/122; 346/140 R

[58] Field of Search ..... 346/1.1, 140 R; 29/890.1; 204/11; 156/625, 664; 205/67-75, 127, 122

[56] References Cited

U.S. PATENT DOCUMENTS

| | | | |
|---|---|---|---|
| 4,184,925 | 1/1980 | Kenworthy | 204/11 |
| 4,438,191 | 3/1984 | Cloutier et al. | 430/324 |
| 4,490,728 | 12/1984 | Vaught et al. | 346/1.1 |
| 4,528,577 | 7/1985 | Cloutier et al. | 346/140 R |
| 4,558,333 | 12/1985 | Sugitani et al. | 346/140 R |
| 4,616,408 | 10/1986 | Lloyd | 29/611 |
| 4,675,083 | 6/1987 | Bearss et al. | 204/11 |
| 4,694,308 | 9/1987 | Chan et al. | 346/140 R |
| 4,773,971 | 9/1988 | Lam et al. | 204/11 |
| 4,809,428 | 3/1989 | Aden et al. | 346/140 R X |
| 4,947,189 | 8/1990 | Braun et al. | 346/140 R |
| 4,971,665 | 11/1990 | Sexton | 204/11 |
| 5,016,024 | 5/1991 | Lam et al. | 346/1.1 |
| 5,019,675 | 5/1991 | Blessington et al. | 346/140 R |

*Primary Examiner*—Benjamin R. Fuller
*Assistant Examiner*—Alrick Bobb

[57] ABSTRACT

A method of manufacturing a thermal ink jet printhead wherein a reusable mandrel consisting of either a metal pattern on an insulating or semiconductive substrate or an insulating pattern on a metal substrate or metal layer is used in the process of electroforming a plurality of metal substrates used for starting a batch fabrication process. Next, thin film layers of insulating, resistive, and conductive materials are formed on the surfaces of the metal substrates to thereby define heater resistors and lead-in conductors for the plurality of thermal ink jet printheads being formed. Then, a barrier layer such as Vacrel is photodefined on the surface of the thin film insulating, resistive, and conductive layers to thereby define a plurality of ink drop ejection chambers surrounding each of the previously formed heater resistors. Next, a plurality of orifice plates are secured, respectively, to the barrier layers in each of the printheads being formed. Finally, the plurality of metal substrates may be removed from the mandrel, such as by stripping away, without the requirement for substrate dicing, and an appropriate mask on the mandrel may be used to create an ink feed hole in each of the metal substrates. The metal substrates are further provided with a break tab line during the electroforming process which is aligned with break patterns in both the above thin film layers and orifice plates. In this manner, the individual thin film printheads may be easily broken away and separated one from another.

20 Claims, 6 Drawing Sheets

PROCESS FOR MANUFACTURING THERMAL INK JET PRINTHEADS HAVING METAL SUBSTRATES AND PRINTHEADS MANUFACTURED THEREBY

TECHNICAL FIELD

This invention relates generally to processes for manufacturing printheads for ink jet pens and more particularly to such processes for fabricating improved thin film resistor type printheads with metal substrates for use in thermal ink jet (TIJ) pens.

RELATED APPLICATION

In co-pending U.S. patent application Ser. No. 07/236,890 of Si Ty Lam et al entitled "Thin Film Mandrels and Metal Devices Manufactured Using Same", filed Aug. 25, 1988, there is disclosed and claimed new and improved processes useful for not only manufacturing general purpose mandrels for making a variety of small geometry metallic devices, but also mandrels useful in the fabrication of nickel orifice plates for thermal ink jet printheads. This co-pending application has an effective filing date of its parent U.S. Pat. No. 4,773,971, and the present application represents still further new and improvements in ink jet printhead manufacture with respect to the inventions disclosed and claimed in the above identified Lam et al co-pending application and in U.S. Pat. No. 4,773,971 from which this co-pending application was derived. Both this patent and co-pending application are incorporated herein by reference.

BACKGROUND ART

In the manufacture of thin film resistor (TFR) type printheads for thermal ink jet pens, it has been a common practice to build up thin film printhead devices from a common insulating or semiconductive substrate such as glass or silicon. These devices typically include a surface insulating layer such as silicon dioxide, $SiO_2$, formed on the silicon or glass substrate surface. A layer of resistive material such as tantalum aluminum, TaAl, is then deposited on the surface of the silicon dioxide insulating layer, and then a conductive trace pattern is formed on the surface of the resistive layer using conventional state-of-the-art photolithographic processes. The conductive trace pattern is photodefined in order to determine the length and width dimensions of the heater resistor areas formed within the tantalum aluminum resistive layer, and this conductive trace pattern further provides electrical lead in connectors to each of the photodefined heater resistor areas in the tantalum aluminum resistive layer.

To complete the composite TIJ printhead structure, a surface dielectric material such as silicon dioxide, $SiO_2$, silicon nitride, $Si_3N_4$, or silicon carbide, SiC, or a composite of the above insulating materials including silicon oxynitride, $SiO_xN_y$, is then frequently deposited on the exposed surfaces of the aluminum trace material and over the exposed surfaces of the heater resistor areas in order to provide a protective coating over these latter areas. Then, a polymer barrier layer material such as Vacrel is applied and photolithographically patterned on top of this latter surface dielectric material to define the dimensions of the ink drop ejection chambers which are positioned to surround and be coaxially aligned with respect to the previously formed heater resistors. Finally, an orifice plate such as nickel is secured to the top of the polymer barrier layer and has orifice openings therein which are also coaxially aligned with respect to the centers of the ink drop ejection chambers and the centers of the previously formed heater resistors.

During the above printhead manufacturing process, it is possible to separate the individual silicon or glass substrates one from another either before or after the above described orifice plate formation step. This is typically done by dicing through the silicon or glass substrate upon which the above individual printhead devices are constructed. This operation is quite dirty, and the substrates must be protected from contamination and damage during the dicing process. The individual printheads must then be subjected to a cleaning cycle before further assembly operations can take place, and these dicing and cleaning operations add a substantial cost to the printhead manufacturing process. In addition, the quality and cost of the glass or silicon substrates are largely controlled by outside vendors, and this in turn may adversely affect the reliability of and quality control over the printhead batch manufacturing process.

Another prior art process for forming thermal ink jet printheads is described in U.S. Pat. No. 4,616,408 issued to William J. Lloyd and entitled "Inversely Processed Resistance Heater". The Lloyd process describes a resistance heater which contains a relatively thick layer of electroplated metal such as nickel or copper deposited on the order of 10 to 1000 microns in thickness and used to serve as both a heat sink and support layer for the ultimately formed thin film printhead structure. This metal layer must then be bonded to another support bearing substrate, and this process is somewhat complicated in its nature and overall number of process steps used therein.

In addition to the above required dicing and cleaning processes used in the manufacture of the prior art thermal ink jet printheads, the above glass or silicon substrates therefor had to be additionally processed in order to form ink feed holes therein for providing a path of ink flow from a source of ink supply within a pen body housing and into the above described ink drop ejection chambers located around each of the heater resistors. These ink feed holes have been formed using sandblasting and laser drilling processes which are difficult to control and somewhat expensive to carry out. In addition, sandblasting is dirty, imprecise, and can create rough areas on the underlying substrate which tend to absorb ink at undesirable locations. Also, as previously indicated the cutting or dicing processes used to separate multiple printheads fabricated on a common wafer are dirty and they add further costs to the above required laser drilling or sandblasting processes which are used to define the ink feed holes in the substrates.

Once completed, the above described TIJ printheads which utilized either glass or silicon substrates in combination with metal orifice plates exhibited a rather poor thermal match characteristic inasmuch as the thermal coefficient of expansion of the glass or silicon substrate is much smaller than the thermal coefficient of expansion of the metal orifice plate. Such thermal expansion mismatch between substrate and orifice plate can cause bowing in the completed printhead structure and even possibly device failure and mechanical separation therein between the substrate and orifice plate. Moreover, the above problem of mismatch in thermal expansion coefficients between substrate and orifice plate gets worse as the printheads get larger and longer, such as for example in the construction of pagewidth printheads. Such pagewidth printheads are becoming more desirable as a necessary means for making high throughput ink jet printers of the future.

DISCLOSURE OF INVENTION

The general purpose and principal object of the present invention is to provide a new and improved process for fabricating thin film printheads useful in the manufacture of thermal ink jet pens and which overcomes all of the above described significant disadvantages of the prior art processes which employ a combination of metal orifice plates and silicon or glass substrates.

To accomplish this object and purpose, we have discovered and developed a new and improved ink jet printhead manufacturing process which includes the steps of:

a. providing a mandrel which is constructed of either a metal pattern on a dielectric or semiconductive substrate or a dielectric pattern on an underlying metal substrate or layer, b. electroplating a metal on top of the exposed metal surfaces of the mandrel so as to form a plurality of discrete metal substrates thereon, each having an ink feed hole photodefined therein, c. forming in sequence thin film insulator, resistor, and conductor patterns on the metal substrates to thereby form a plurality of heater resistor areas with defined length and width dimensions, d. forming a barrier layer on the insulator, resistor, and conductor patterns to define a plurality of ink drop ejection chambers surrounding the heater resistors, e. securing metal orifice plates on top of each of the barrier layers and having openings therein aligned respectively with respect to the ink drop ejection chambers and the heater resistors, and f. removing the metal substrates from the mandrel, such as by stripping away therefrom, whereby the printheads may be cleanly separated from the mandrel without the requirement for using a dicing process or the like. In addition, ink feed holes are provided in the metal substrates without requiring sandblasting, laser drilling, or other like processes during the formation of a composite metal substrate-metal orifice plate ink jet printhead having good thermal matching characteristics.

Using the above process, the metal substrates may be removed from the mandrel either before they are processed as described or after the orifice plates are secured thereto. Furthermore, the metal substrates are electroformed on the mandrel so as to have break tab lines which define the outer boundary of each metal substrate which may be easily broken away from its adjacent substrates after the above orifice attachment process has been completed.

Other objects, novel features and related advantages of this invention will become more readily apparent from the following description of the accompanying drawing.

DETAILED DESCRIPTION OF THE PREFERRED EMBODIMENT

Figures 1A, 1B:
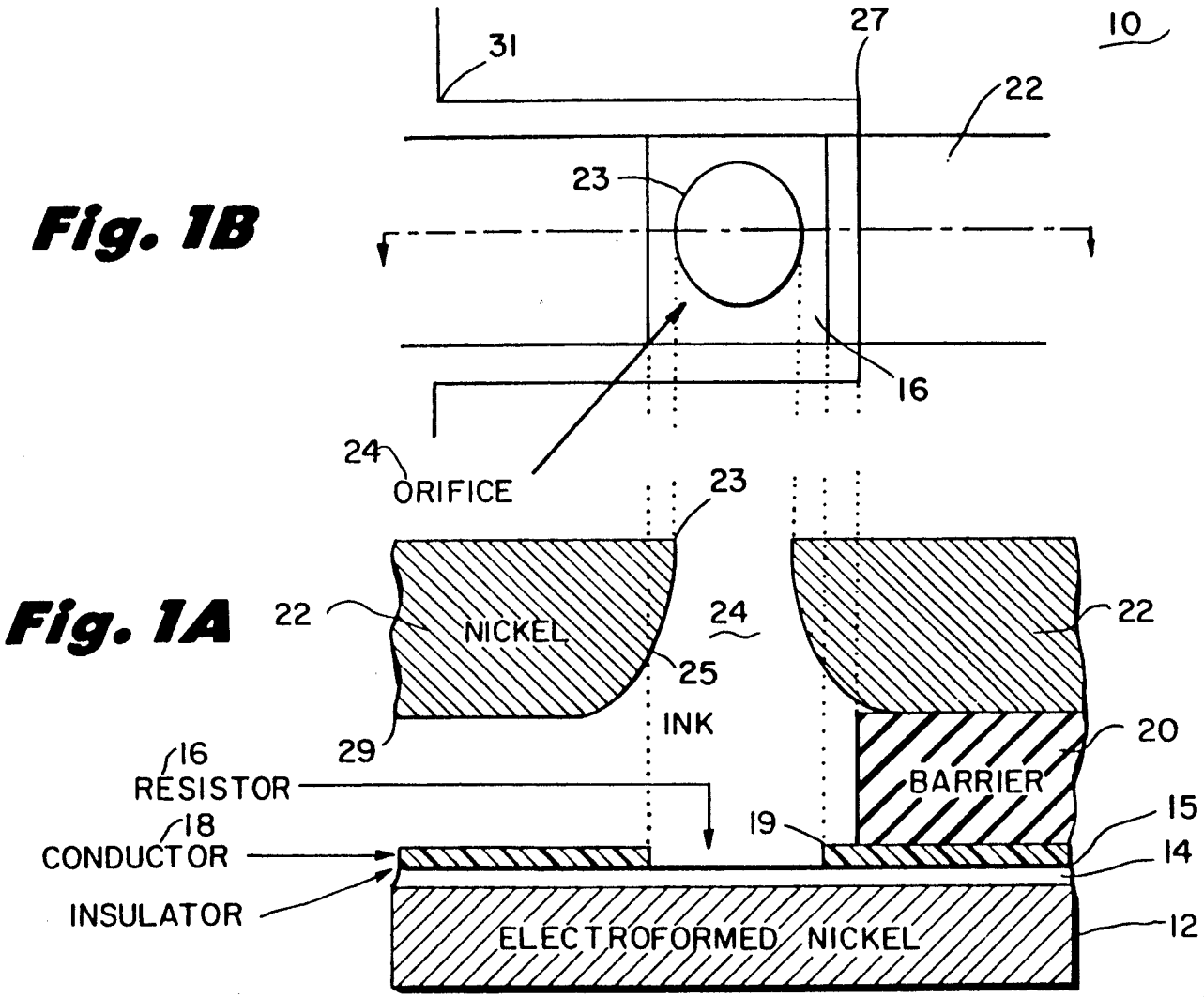
FIG. 1A is an abbreviated and fragmented cross-section view of a section of a thermal ink jet printhead which has been manufactured in accordance with the present invention.
FIG. 1B is a plan view showing the geometry of the ink feed channel, heater resistor surface area, and orifice plate of the structure shown in FIG. 1A.

Referring now to FIGS. 1A and 1B, there is shown an electroformed nickel substrate 12 which has been developed using the electroplating process used in the above identified and co-assigned U.S. Pat. No. 4,773,971. An insulating layer 14 such as sputter deposited silicon dioxide is formed on the upper surface of the electroformed nickel substrate 12 to a thickness typically on the order of about 0.5 to 3.0 micrometers. The $SiO_2$ insulating layer 14 will typically be covered with a thin surface layer 15 of a chosen resistive material, such as tantalum aluminum, and in the following step of the process a conductive pattern 18 is formed on the upper surface of the tantalum aluminum resistive layer 15 in order to define the boundaries of a resistive heater area or "resistor" 16 within the opening 19 of the conductive trace material 18.

In a following step of the process, a thick polymer barrier layer 20 of a suitable polymeric material such as Vacrel is deposited and photodefined on the upper surface of the conductive trace pattern 18 using state of the art photolithographic masking and etching techniques such as those described, for example, in the *Hewlett Packard Journal*, Volume 36, No. 5, May 1985, incorporated herein by reference.

Referring now more specifically to FIG. 1B, the typical geometry for the nickel orifice plate 22 will be rectangular in shape and will include an outer orifice opening 23 which is centered and co-aligned with the center line of the rectangular heater resistor. The complete orifice passage in FIG. 1A is generally designated as 24 and includes convergently contoured sidewalls 25 which are the preferred orifice geometry for the efficient ejection of ink onto a printed media and to minimize gulping during an ink jet printing operation. The plan view geometry of the barrier layer 20 in FIG. 1A is indicated by the boundary 27 as shown in FIG. 1B and is somewhat larger than the width dimension of the conductive line 18. The rectangular barrier layer boundary 27 defines the X and Y dimensions of the drop ejection chamber surrounding the heater resistor 16, and this drop ejection chamber is hydraulically coupled to receive ink from left to right and through the opening indicated at 29 in FIG. 1A and at 31 in FIG. 1B.

Thus, it should be fully appreciated at this point in the description that by having both the substrate member 12 and the orifice plate member 22 electroformed of the same metal, such as nickel in the present example, these members 12 and 22 will expand and contract in a like manner when undergoing temperature cycling and will therefore exert equal and uniform forces and stresses on the insulative, resistive, conductive, and polymer barrier layers 14, 15, 18, and 20 which are positioned therebetween as previously described. Thus, by ensuring that both the nickel substrate 12 and the nickel orifice plate 22 will expand and contract identically when exposed to the same temperature cycling, uneven stresses which can cause warping and produce other similar degrading characteristics within the printhead structure are avoided.

Figures 2A, 2B:
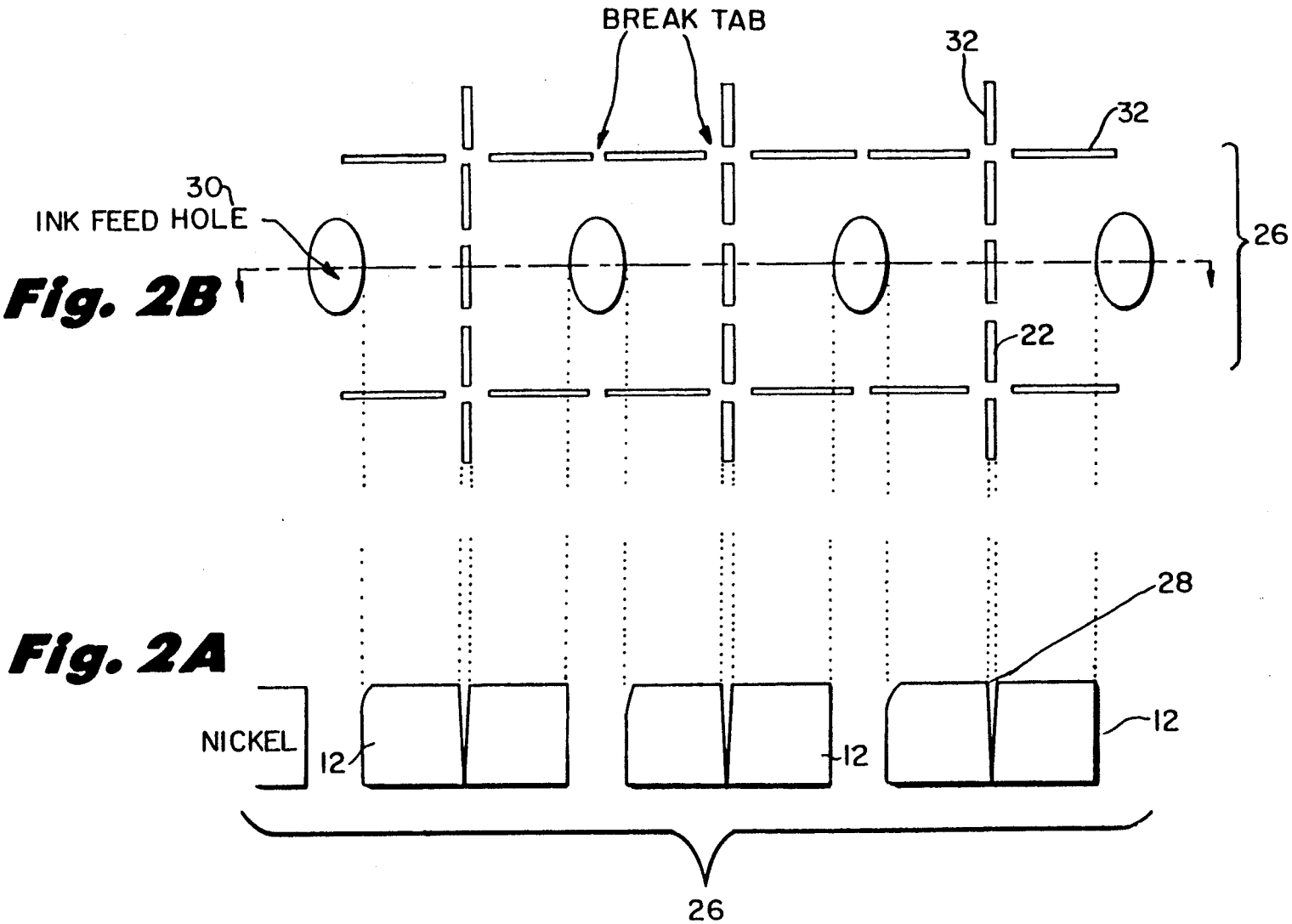
FIGS. 2A and 2B, respectively, are elevation and plan views of an electroformed nickel substrate assembly shown before the individual nickel substrates are broken apart to form the foundations of the manufactured thermal ink jet printheads.

Referring now to FIGS. 2A and 2B, the insulating electroplating mask geometries used in the electroforming mandrels are selected so as to enable the plurality 26 of nickel substrates 12 to plate up in the thin V-shaped geometries 28 as shown in FIG. 2A. In addition, the openings 28 in FIG. 2A at the tops of the V grooves correspond to the rectangular openings 22 as shown in FIG. 2B and define the break tab points for separating the nickel substrates one from another after the printhead wafer fabrication process described herein has been completed. The nickel substrates 12 illustrated in FIGS. 2A and 2B also include a plurality of ink feed holes 30 which are defined by the circular or oval shaped geometries of the insulating pattern on the mandrels which were used to form the nickel substrates 12.

Figures 3A, 3B:
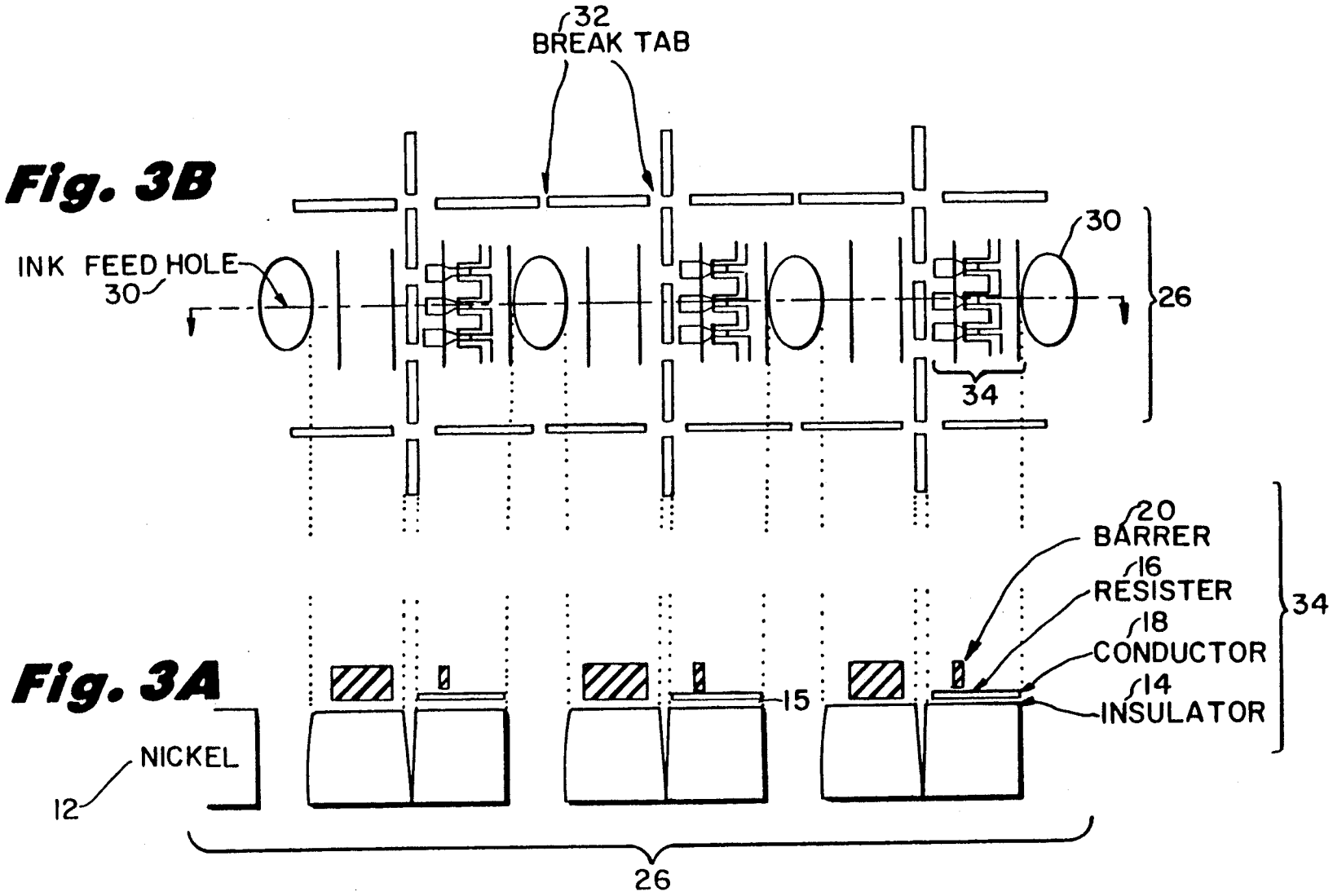
FIGS. 3A and 3B are elevation and plan views, respectively, showing the geometry of a partially fabricated printhead wherein insulative, conductive, resistive, and polymer barrier layers are built up on the surface of the previously formed nickel substrates.

Referring now to FIGS. 3A and 3B, these figures illustrate the successive deposition and formation of a first surface insulator layer 14 on the surface of a nickel substrate 12 and then the formation of the resistive layer 15 on the surface of the insulating layer 14 to serve as the resistive heater material over which the succeeding conductive trace pattern 18 is deposited using well known aluminum vacuum deposition and patterning processes. Then, the polymer barrier layer material 20 is formed in the geometry shown directly upon the upper surface of the conductive trace material 18. However, in certain alternative embodiments it may be preferred to add another additional passivation layer such as a composite deposition of silicon nitride and silicon carbide (not shown) interposed between the lower surface of the polymer barrier layer material 20 and the upper surface of the conductive trace pattern 18 and resistive heater material 15.

Figures 4A, 4B:
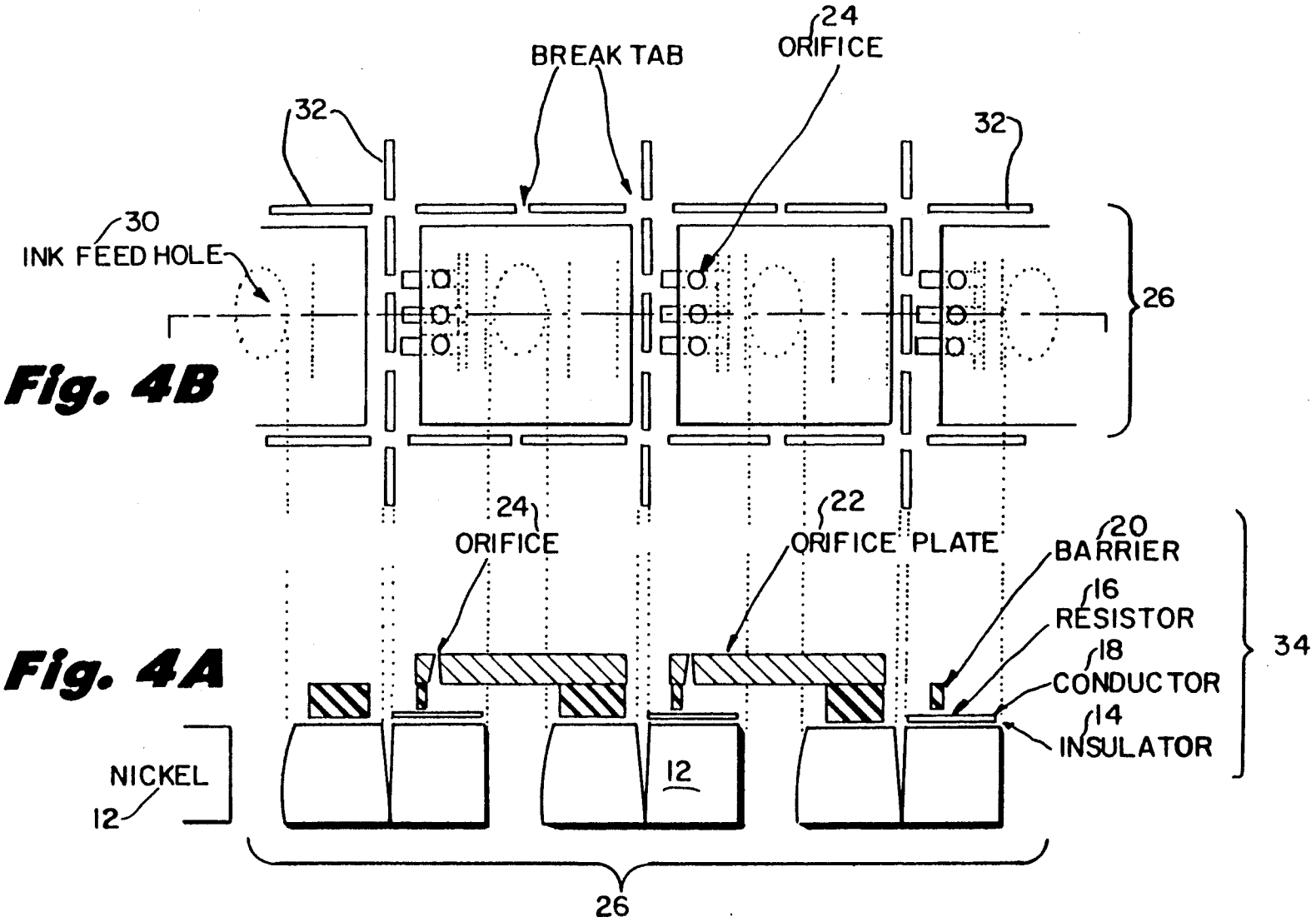
FIGS. 4A and 4B elevation and plan views, respectively, showing the addition of a plurality of outer metal orifice plate structures to the previously formed polymer barrier layer defining the boundaries of the printhead drop ejection chambers and associated ink feed channels.

Referring now to FIGS. 4A and 4B, these figures illustrate the orifice plate attachment process wherein a plurality of individual orifice plates 22 having orifice openings 24 therein are attached, using well known orifice plate alignment and attachment processes, to the upper surfaces of the polymer barrier layer 20 which defines, as previously indicated, the ink flow channels and drop ejection chambers. These channels and firing chambers are fluidically coupled to the ink feed ports 30 and extend beneath the surfaces of the orifice plates 22 and then over the resistive heater areas 16 in each ink jet printhead which are aligned with the orifice openings 24, respectively.

Upon the completion of the orifice plate attachment process shown in FIGS. 4A and 4B, the nickel substrates may be separated one from another by merely breaking the substrates at the V-shaped break tab points indicated in these figures and without the undesirable requirement for wafer dicing and all of its above described attendant disadvantages.

Figure 5:
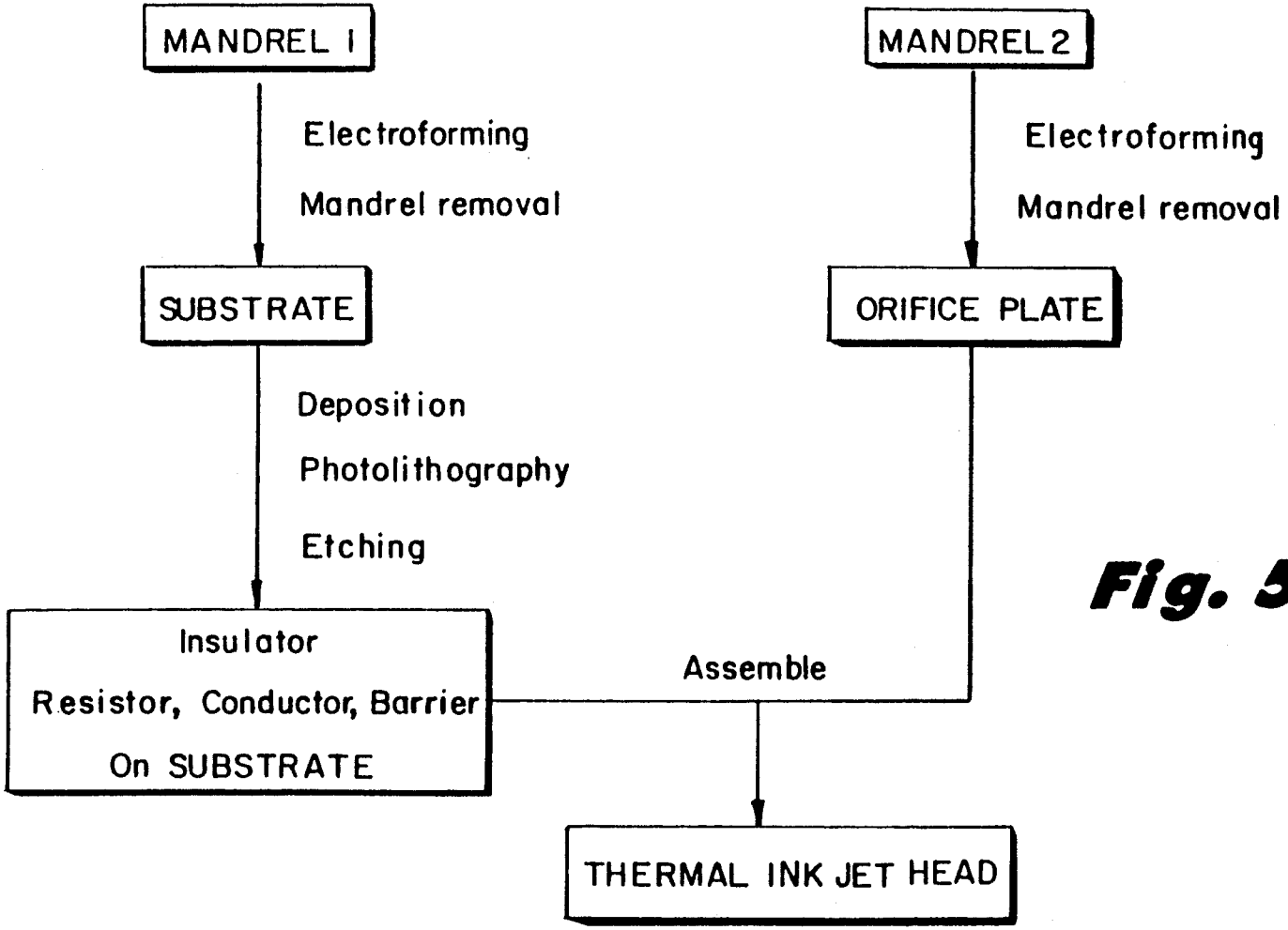
FIG. 5 is a process flow chart which summarizes the dual mandrel fabrication process used to manufacture the thermal ink jet printheads in accordance with the present invention.

Referring now to the process flow diagram shown in FIG. 5, it is seen that a first mandrel, or mandrel number 1, may be used in the formation of the nickel substrates in a parallel processing scheme with the use of a second mandrel, or mandrel 2, which is used in forming the nickel orifice plates. In this parallel processing scheme, we employ electroplating techniques of the type described in the above identified U.S. Pat. No. 4,773,971 issued to Si Ty Lam et al and assigned to the present assignee. The nickel substrate formed using the mandrel number 1 as indicated in FIG. 5 then undergoes layer deposition steps in the above described and depicted sequence and wherein the geometry of the conductive trace material and heater resistors defined thereby are photodefined using known state-of-the-art photolithographic masking and etching techniques. Then, the nickel orifice plates generated in the right hand branch of the flow chart in FIG. 5 are assembled with the processed thin film substrates formed in the left hand branch of FIG. 5 in a final assembly process used to assemble the completed thermal ink jet printhead as described above in FIGS. 4A and 4B.

Referring now in sequence to FIGS. 6A through 6E, these schematic cross-section views are presented herewith in order to show specifically how the break points or openings in the polymer barrier layer and in the overlying orifice plate are aligned with the break tab lines in the underlying nickel substrate. These figures further show the geometries of the ink feed paths and drop ejection chambers in relation to the ink feed holes in the nickel substrates.

Figure 6A:
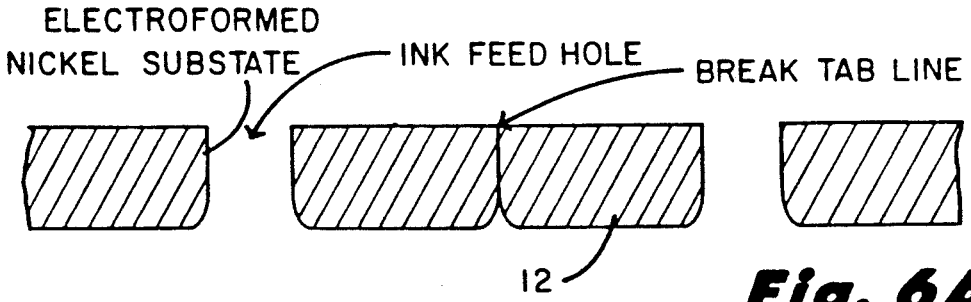
FIG. 6A through 6E are a series of abbreviated schematic cross-section views used to illustrate the claimed sequence of manufacturing process steps and which are commensurate in scope with the broad process and device claims appended hereto. These two figures are also used to more specifically show the geometries of the ink feed channels and drop ejection chambers in relation to the ink feed openings in the nickel substrates, and also the alignment of the break tab lines in the substrates with the break lines in the overlying barrier layers and orifice plates.
Figure 6B:
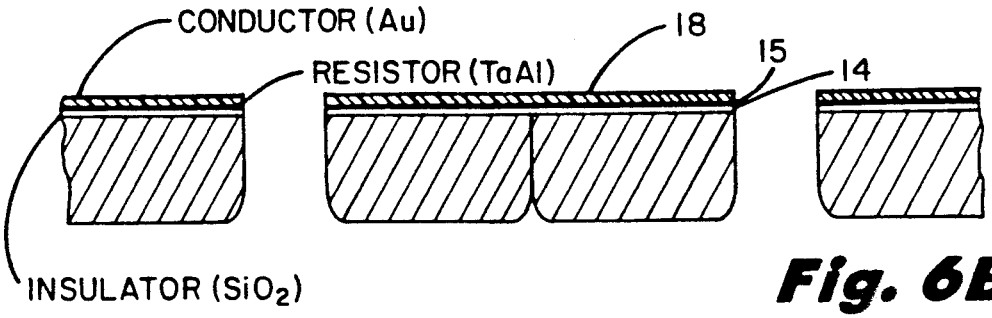

As shown in FIGS. 6A and 6B, the upper surfaces of the nickel substrates 12 will be exposed to the first three series of layer deposition steps, with the thin film structure resulting therefrom shown in FIG. 6B. FIG. 6B shows that co-extensive and successive layers 14, 15, and 18 of insulator ($SiO_2$), resistor, (TaAl), and conductor (Au or Al), respectively, are formed in succession and extend from the edges of each of the adjacent ink feed holes 30 and extend symmetrically across the break tab lines in the nickel substrate 12.

Figure 6C:
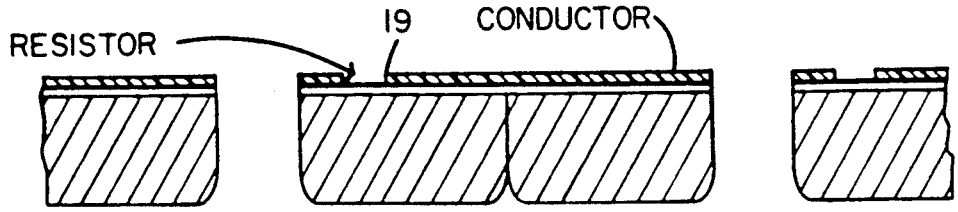

In FIG. 6C, the conductive layer 18 is masked and etched in order to form the opening 19 therein which defines the boundaries of the heater resistor element 16 as shown adjacent to the conductive trace material at each left hand edge of the nickel substrates 12. Next, as shown in FIG. 6D, the polymer barrier layer 20 is formed and is provided with a central break opening therein which is aligned with the break tab line in the underlying nickel substrate.

Figure 6D:
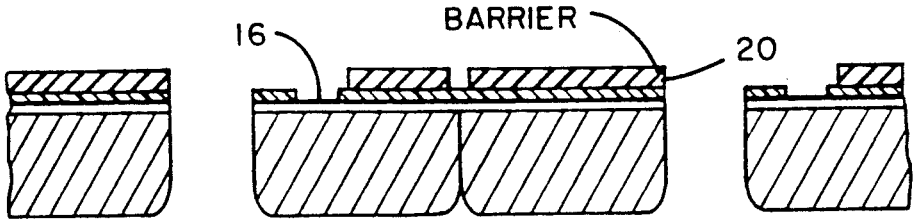
Figure 6E:
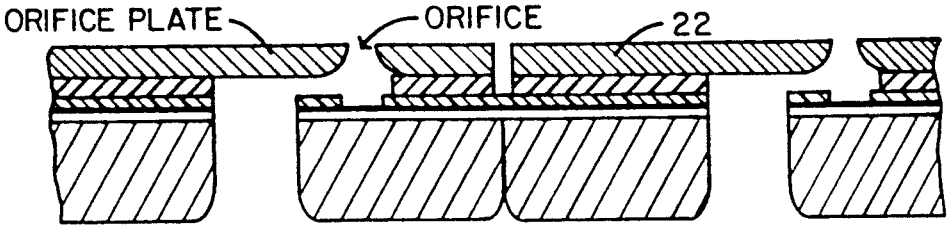

Then, in FIG. 6E, the orifice plate 22 having the convergent orifice geometry openings as shown is attached to the upper surface of the polymer barrier layer 20 in FIG. 6D and also has a break opening therein aligned with both the break opening in the underlying polymer barrier layer and the break tab line in the underlying nickel substrates. Therefore, when the structure shown in FIG. 6E has been completed, the nickel substrates may be easily broken apart at the break tab lines shown therein, and the aligned break openings in the overlying barrier layer 20 and orifice plate 22 allow for sufficient flexure to take place in the nickel substrates so that the individual substrates will simply snap away from one another and create vertical break boundaries through the surface layers 14, 15, and 18 previously described.

Various modifications may be made in and to the above described embodiment without departing from the spirit and scope of this invention. For example, the above described process is not limited to either the elevation or plan view geometries specifically shown in the various figures, nor to the particular exemplary insulator, conductor, and resistor materials and to the substrate and orifice plate materials specifically described. Furthermore, the present invention is not limited to the above identified mandrel processes for forming the nickel substrates and is intended to cover various different printhead structural combinations and architectures wherein matching metal orifice plates and metal substrates are employed. Accordingly, these and other obvious design modifications are clearly within the scope of the following appended claims.

We claim:

1. A method of making an ink jet printhead which includes the steps of:

a. forming individual metal substrates on exposed metal areas of a mandrel by electroplating thereon, b. forming thin film resistor pattern defining layers on said metal substrates, and then c. forming metal orifice plates of the same material as that of said metal substrates above said thin film resistor pattern defining layers, whereby said metal substrates may be easily stripped away from said mandrel after formation of said orifice plates thereover, and said metal substrates and metal orifice plates are chosen from the same metal so as to exhibit thermal matching characteristics and minimize stresses in said printhead during operation thereof.

2. A process for manufacturing thermal ink jet printheads having thin film insulator, resistor and conductor layers formed on underlying substrates and further having barrier layers and orifice plates formed on said thin film layers to define ink feed channels, drop ejection chambers, and ink ejection openings in said printheads, characterized by the steps of:

a. electroforming a metal substrate and a metal orifice plate on separate mandrels, and b. attaching said orifice plate to a barrier layer thereon and said orifice plate being of the same metal as said substrate so that said substrate and said orifice plate exhibit thermal matching characteristics and thereby minimize structural stresses within said printheads during operation thereof.

3. The process defined in caim 2 wherein said mandrels are constructed of either metal patterns disposed on non-metallic substrates or underlayers or non-metallic patterns disposed on metallic substrates or underlayers.

4. The process defined in claim 3 which further includes processing said orifice plates and substrates in parallel electroforming processes so that break patterns formed in said orifice plates are aligned with break lines formed in said metal substrates.

5. The process defined in claim 4 which further includes electroforming ink feed openings in said metal substrates.

6. The process defined in claim 4 which further includes forming break patterns in said barrier layer which is aligned with said break patterns and lines in said orifice plates and substrates, respectively.

7. The process defined in claim 6 wherein said orifice plates and substrates are electroformed of nickel.

8. A thermal ink jet printhead having thin film insulator, resistor, and conductor layers formed on underlying substrates and further having barrier layers and orifice plates formed on said thin film layers to define ink feed channels, drop ejection chambers, and ink ejection openings in the printhead manufactured by a process comprising the steps of:

electroforming a metal substrate and a metal orifice plate on separate mandrels, wherein said mandrels are constructed of either metal patterns disposed on non-metallic substrates or underlayers or non-metallic patterns disposed on metallic substrates or underlayers;

attaching said orifice plate to a barrier layer thereon and said orifice plate being of the same metal as said substrate so that said substrate and said orifice plate exhibit thermal matching characteristics and thereby minimize structural stresses within the thermal ink jet printhead during the operation thereof;

processing said orifice plate so that break patterns formed in said orifice plate are aligned with break lines formed in said metal substrate; and forming break patterns in said barrier layers which are aligned with said break patterns and lines in said orifice plates and substrates, respectively.

9. A thermal ink jet printhead being formed of a composite structure including a metal substrate and a metal orifice plate formed above said substrate and having thin film patterns of insulating, resistive, and conductive materials formed therebetween and constructed by the process of:

a. providing a mandrel which is constructed of either a metal pattern on a non-metallic substrate or a dielectric pattern on an underlying metallic substrate or layer, b. electroplating a metal on top of the exposed metal surfaces of said mandrel so as to form a plurality of discrete metal substrates thereon, each having an ink feed hole and a break line therein, c. forming in sequence thin film insulator, resistor, and conductor patterns on said metal substrates to thereby form a plurality of heater resistor areas with defined length and width dimensions, d. forming a barrier layer on said insulator, resistor, and conductor patterns to define a plurality of ink drop ejection chambers surrounding said heater resistors, e. securing metal orifice plates on top of said barrier layer and having openings therein aligned respectively with said drop ejection chambers and said heater resistors, and f. removing said metal substrates from said mandrel, such as by striping away therefrom, whereby said printheads may be cleanly separated from said mandrel without the requirement of using a process like dicing, and in addition ink feed holes are provided in said metal substrate without requiring such process like sandblasting or laser drilling during the formation of a composite metal substrate-metal orifice plate ink jet printhead having good thermal matching characteristics.

10. A process for manufacturing thin film printheads for thermal ink jet pens which comprises the steps of:

a. electroforming a plurality of metal substrates which may or may not have ink feed holes therein and which are joined together at break lines or junctions during printhead assembly, b. forming thin film insulator, resistor, and conductor patterns on said metal substrates, c. forming barrier layers and orifice plates atop said patterns in (b) above to thereby define ink drop ejection chambers and orifice openings, respectively, above heater resistor areas within said patterns in (b) above, and d. separating said plurality of substrates at said break lines or junctions.

11. The process defined in claim 10 which further includes forming break patterns in said barrier layer and orifice plates which are aligned with said break lines or junctions between said metal substrates.

12. The process defined in claim 10 wherein said orifice plates are electroformed of a metal which is the same metal as that of said substrates.

13. The process defined in claim 12 wherein both said metal substrates and orifice plates are electroformed on mandrels comprising either metal patterns on non-metallic substrates or underlayers or non-metallic patterns on metallic substrates or underlayers.

14. The process defined in claim 12 which includes forming break patterns in said barrier layers and orifice plates which are aligned with said break lines or junctions between said metal substrates.

15. The process defined in claim 14 wherein said mandrel used in the formation of said substrates is patterned so that the substrate metal is electroformed to have both ink feed openings and break tab lines therein.

16. The process defined in claim 15 wherein said mandrel used in the formation of said orifice plates is patterned so that the orifice plate metal is electroformed to have both convergent orifice openings and break lines or patterns which are adapted for alignment with said break lines or junctions in said metal substrates.

17. The process defined in claim 16 wherein said orifice plates and substrates are both electroformed of nickel, and said barrier layers are photodefined to have a break pattern therein which is aligned with said break pattern and lines in said orifice plates and substrates, respectively.

18. A thermal ink jet printhead which is manufacturing by a process comprising the steps of:

electroforming a plurality of metal substrates which are joined together at break lines or junctions during printhead assembly, said plurality of metal substrates are formed from a mandrel patterned to have both ink feed openings and break tab lines therein;

forming thin film insulator, resistor, and conductor patterns on said plurality of metal substrates;

forming barrier layers and orifice plates atop said conductor patterns to thereby define ink drop ejection chambers and orifice openings, respectively, above heat resistor areas within said conductor patterns, wherein said orifice plates are electroformed of a metal which is the same metal as that of said substrates;

forming break patterns in said barrier layers and orifice plates which are aligned with said break lines or junctions between said metal substrates; and separating said plurality of substrates at said break lines or junctions.

19. A method of manufacturing an ink jet printhead including the steps of:

a. providing a mandrel which is constructed of either a metal pattern on a non-metallic substrate or a dielectric pattern on an underlying metallic substrate or layer, b. electroplating a metal on top of the exposed metal surfaces of said mandrel so as to form a plurality of discrete metal substrates thereon, each having an ink feed hole therein, c. forming in sequence thin film insulator, resistor, and conductor patterns on said metal substrates to thereby form a plurality of heater resistor areas with defined length and width dimensions, d. forming a barrier layer on said insulator, resistor, and conductor patterns to define a plurality of ink drop ejection chambers surrounding said heater resistors, e. securing metal orifice plates on top of said barrier layer and having openings therein aligned respectively with said ink drop ejection chambers and said heater resistors, and f. removing said metal substrates from said mandrel, such as by striping away therefrom, whereby said printheads may be cleanly separated from said mandrel without the requirement of using a process like dicing and in addition ink feed holes are provided in said metal substrate without requiring such processes like sandblasting or laser drilling during the formation of a composite metal substrate-metal orifice plate ink jet printhead having good thermal, matching characteristics.

20. The method defined in claim 19 wherein said metal substrates may be removed from said mandrel either before or after said orifice plates are secured thereto.

* * * * *